United States Patent [19]

Amonett

[11] Patent Number: 4,538,037

[45] Date of Patent: Aug. 27, 1985

[54] CLUTCH FOR A TIMING MECHANISM

[75] Inventor: Daniel K. Amonett, Indianapolis, Ind.

[73] Assignee: Emhart Industries, Inc., Indianapolis, Ind.

[21] Appl. No.: 615,776

[22] Filed: May 31, 1984

[51] Int. Cl.[3] ..... H01H 43/10

[52] U.S. Cl. ..... 200/38 R; 200/38 B; 200/153 P

[58] Field of Search ..... 200/38 R, 38 B, 38 D, 200/38 DA, 153 P

[56] References Cited

U.S. PATENT DOCUMENTS 4,103,119 7/1978 Homan et al. ..... 200/38 B X 4,292,482 9/1981 Smock et al. ..... 200/143 P X

*Primary Examiner*—G. P. Tolin

*Attorney, Agent, or Firm*—Robert F. Meyer

[57] ABSTRACT

A shaft is rotatably journalled between end plates. A first drive gear and a first set of cams are fixedly carried on the shaft. A second cam and a second drive gear are integrally constructed to provide a one-piece construction which is independently rotatable of the shaft. A motor drive has two separate output pinions rotating at different speeds each separately connected to the first and second drive gears. The output pinion connected to the second drive gear is connected through a lost-motion connection.

4 Claims, 3 Drawing Figures

CLUTCH FOR A TIMING MECHANISM

BACKGROUND OF THE INVENTION

This invention relates, in general, to a timing mechanism and in particular to a timing mechanism particularly adaptable for controlling a laundry dryer through a timed fabric treatment cycle.

Some automatic clothes dryers include an anti-wrinkle control system that provides for rearranging and refluffing permanent press fabrics every few minutes if they are not removed from the dryer at the end of a permanent press cycle, a buzzer sounds to remind a housewife, for example, that her clothes are ready. If she is busy or out of the home, the anti-wrinkle control starts the dryer at predetermined intervals, for example every five minutes and tumbles the clothes for a predetermined interval, for example, 10 seconds. At the end of each 10 seconds of tumbling, the dryer again buzzes to remind the housewife to remove the clothes. The dryer continues to "nag" in this manner for a predetermined period of time, for example, up to two and one half hours. However, for the times illustrated, total running time for the dryer would only be five minutes.

In U.S. Pat. No. 4,103,119 issued July 25, 1978 there is described and claimed a timing mechanism wherein two separate sets of cams are independently rotated by a single motor drive having a gear train with two separate outputs. While the timing mechanism very adequately provides a separate "pulsing cycle" for anti-wrinkle control, it does present one or two problems with regard to the manner in which the "pulser cam" is constructed and the manner in which it is coupled to the drive motor. More particularly, the pulser cam is of a two piece construction which adds to the cost of the timing mechanism and which in conjunction with the manner in which the cam is coupled to the motor drive makes it difficult under certain circumstances to achieve a fast make and break between electrical contacts. This is especially critical where, as in the present application, a pulsing action is required.

SUMMARY OF THE INVENTION

Accordingly, there is provided a timing mechanism which improves on the timing mechanism of U.S. Pat. No. 4,103,119 by providing a one-piece cam construction and a lost-motion connection between the cam and the motor drive. In general, the timing mechanism comprises a shaft rotatably journalled between end plates, a first drive gear fixedly carried by the shaft, first cam means fixedly carried by the shaft, a unitarily constructed second drive gear and second cam means carried by the shaft and independently rotatable thereof, motor drive means and a gear train connected thereto, the gear train including first and second output pinions providing two rotational outputs at different speeds, the first output pinion engaging the first drive gear, the second output pinion engaging the second drive gear and providing a lost-motion connection between the two, and electrical switch means opening and closing in response to the rotation of the first and second cam means.

DETAILED DESCRIPTION OF THE INVENTION

Figure 1:
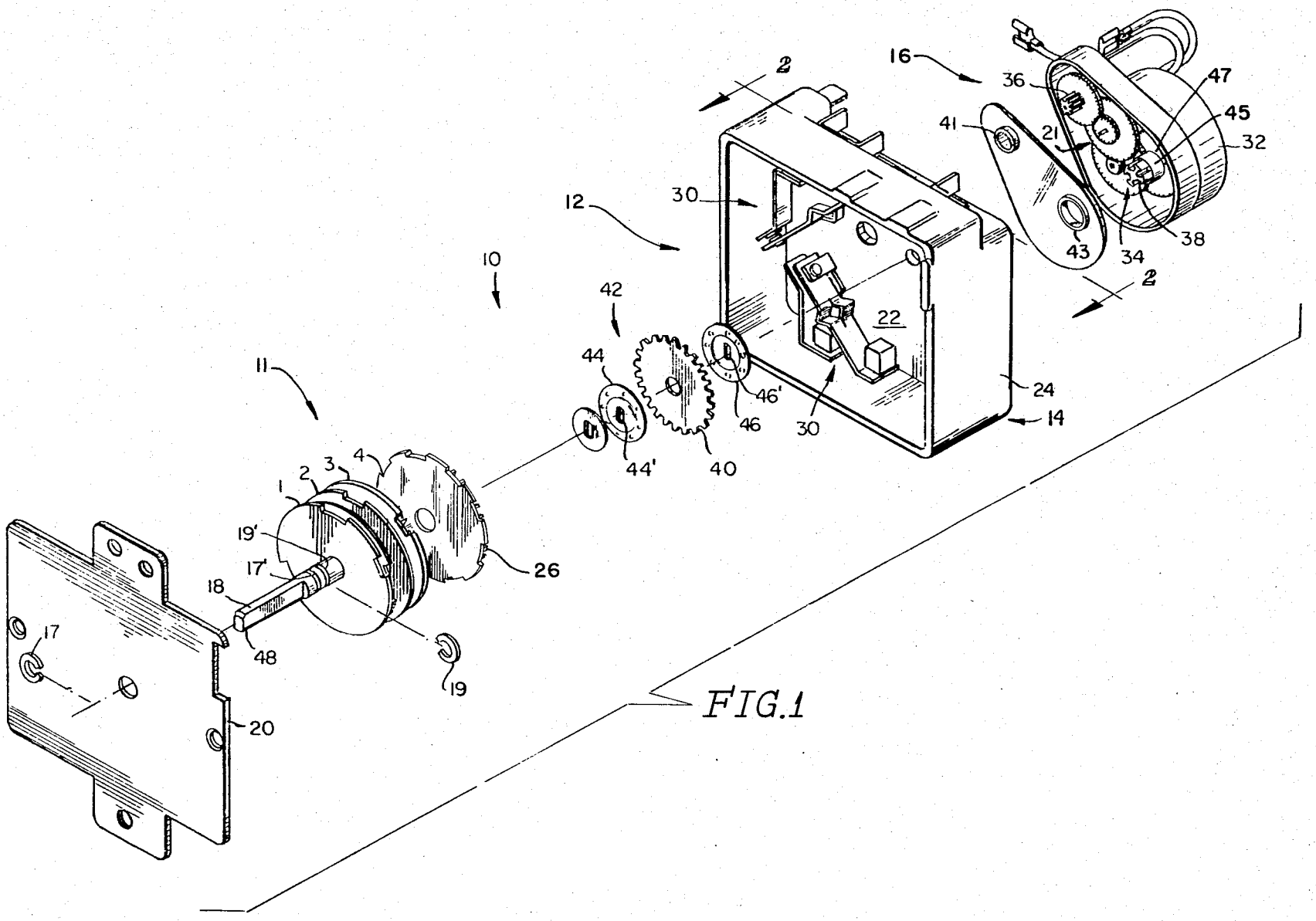
FIG. 1 is an exploded view of the timing mechanism.

Referring now to the drawings, timing mechanism 10, in general, includes a timer section 12 carried in a housing 14 and a motor drive section 16 carried on the outside of the housing. A cam assembly 11 is carried on a shaft 18. Shaft 18 is rotatably journalled in end plates 20 and 22, end plate 22 being the bottom portion of cup shaped member 24 and end plate 20 providing a cover which closes the cup shaped member. Axial displacement of the shaft is prevented through C-rings 17 and 19 engaging grooves 17' and 19' on either side of end plate 20. Cam assembly 11 includes a first cam means consisting of cams 1–3 each fixedly carried on the shaft through a double-D aperture mating with the double-D portion 28 of the shaft. The cam assembly also includes a second cam means consisting of cam 4 which is integral with drive gear 26 to provide a one-piece construction between the. cam and the gear. Gear 26 is freely rotatable about the shaft; thus cam 4 is freely and independently rotatable about the shaft. Each of the cam means are driven separately but simultaneously through motor drive 16. Rotation of the cam means causes switch means 30 to open and close in accordance with the cam lobes associated therewith.

Figure 3:
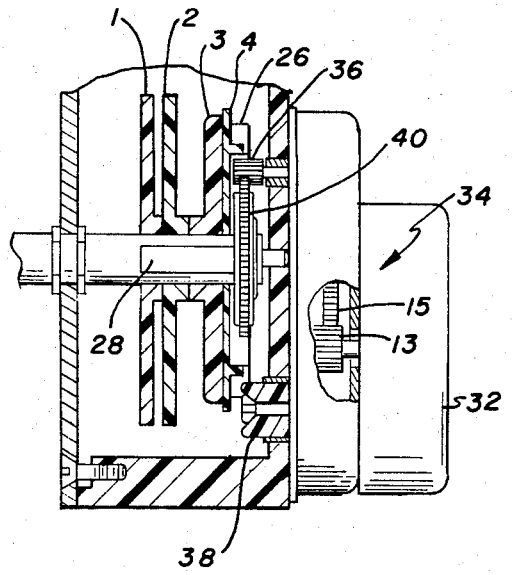
FIG. 3 is a partial section taken along the line 3—3 of FIG. 2.

Motor drive means 16 includes a motor 32, generally of the synchronous type, and a speed reducing means consisting of a gear train 34 coupled to the motor. As shown in FIGS. 1 and 3, gear train 34 includes an input gear 15 engaging an output pinion 13 of motor 32, and a series of cooperating gears and pinions 21 coupling two separate output pinions 36 and 38 provided at different stages of the gear train. Therefore two different output speeds are provided simultaneously, with pinion 36 providing a slower output speed. Pinion 36 extends through aperture 41 and engages drive gear 40 which is freely rotatable about shaft 18. The drive gear is coupled to the shaft through a clutch means 42 which includes a pair of spring washers 44 and 46 which frictionally engage opposed faces of the gear and are fixedly carried by shaft 18 through double-D apertures 44' and 46'. Thus output pinion 36 drives shaft 18 and thus cams 1–3 at one speed. The use of the clutch permits the shaft and thus the cam means to be manually set through a knob (not shown) carried on the end 48 of the shaft. Pinion 38 engages drive gear 26 which, as previously noted, is freely rotatable about the shaft 18 so as to be rotatable independently of the shaft. Since cam 4 is coupled to gear 26, it is rotated independently of shaft 18 at the speed of output pinion 38.

Figure 2:
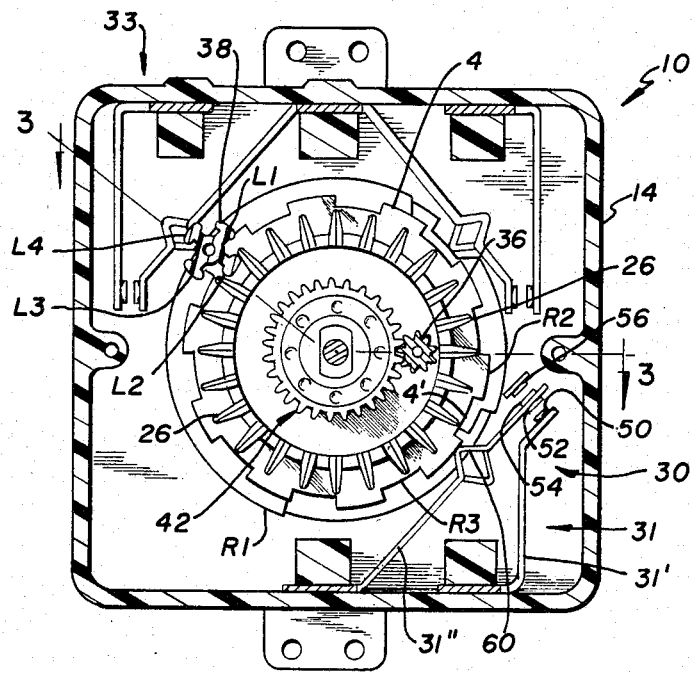
FIG. 2 is a section of the timing mechanism taken along line 2—2 of FIG. 1.

In addition to the integral construction of drive gear 26 and cam 4, the present invention contemplates a lost-motion connection between pinion 38 and drive gear 26. As shown, output pinion 38 includes four equally spaced legs L1, L2, L3 and L4 that extend from a hub 45 which is integral with gear 47 of gear train 34 through aperture 43 to engage gear 26. As best shown in FIG. 2, the thickness of the legs are less than the spacing between the teeth of gear 26 to provide the desired lost-motion connection. More particularly, as viewed in FIG. 2, pinion 38 is turning counterclockwise to drive gear 26 clockwise through leg L2. When follower 60 engages a notch 4' of cam 4, gear 26 will tend to spring forward or flip. It will be permitted to do so because of the space between the trailing edge of leg L2 and the next gear tooth. This provides the necessary "pulsing" action. In order to provide a smooth "ramping action" during the flip of the gear, its teeth are triangular in cross section to provide a ramp for the motion of the leg.

In operation, the slower output pinion 36 rotates cams 1–3 at a predetermined speed through drive gear 40 while output pinion 38 rotates cam 4 at a faster speed through drive gear 26. Cams 1 and 2 operate switches typically shown as switch means 33. The pulsing is provided by cams 3 and 4 in conjunction with switch 31. Cam 3, in addition to providing other functions, cooperates with cam 4 to provide three working radii: R1 of cam 3, R2 of cams 3 and 4, and R3 of cams 3 and 4. Switch 31 is responsive to the combination of cams 3 and 4 and comprises a fixed blade 31' carrying fixed contact 50, movable blade 31" carrying contacts 52 and 54, cam follower 60, and fixed contact 56. Follower 60 is responsive to both cams. With the follower riding on surface R2 (cam 3 and 4) as shown, no contacts are engaged. With the follower engaging surface R1 (cam 3) contacts 50 and 52 are closed. With the two surfaces R3 and cams 3 and 4 coinciding at the follower, contacts 54 and 56 are closed. And since cam 4 is rotating faster, contacts 56 and 54 will be open and closed many times during the period that the follower is "in line" with R3 of cam 3. This provides selective pulsing which may be used in anti-wrinkle control, for example.

What is claimed is:

1. A timing mechanism comprising:

(a) a shaft rotatably journalled between end plates, (b) a first drive gear fixedly carried by said shaft, (c) first cam means fixedly carried by said shaft, (d) a one piece integrally constructed second cam means and a second drive gear carried by said shaft and independently rotatable thereof, (e) motor drive means and a gear train connected thereto, said gear train including at least two output pinions providing two rotational outputs at different speeds, one of said two output pinions connected to said first drive gear, the other output pinion of said two output pinions connected to said second drive gear through a lost motion connection, and (f) electrical switch means opening and closing in response to the rotation of said first and second cam means.

2. A timing mechanism according to claim 1 wherein said other output pinion includes legs extending from a hub carried by a gear of said gear train.

3. A timing mechanism according to claim 2 wherein the thickness of said legs is less than the space between the teeth of said second drive gears to provide said lost motion connection.

4. A timing mechanism according to claim 3 wherein there are four of said legs equally spaced from one another.

* * * * *